US006338758B1

(12) United States Patent
Curran

(10) Patent No.: US 6,338,758 B1
(45) Date of Patent: Jan. 15, 2002

(54) MULTIPLE OBJECT PAINT RACK SYSTEM

(76) Inventor: William F. Curran, 22 Armstrong Cir., Braintree, MA (US) 02184

( * ) Notice: Subject to any disclaimer, the term of this patent is extended or adjusted under 35 U.S.C. 154(b) by 0 days.

(21) Appl. No.: 09/540,504

(22) Filed: Mar. 31, 2000

(51) Int. Cl.[7] ..... B05C 13/02

(52) U.S. Cl. ..... 118/500; 118/502; 118/503; 269/905; 211/162; 211/163; 248/129; 248/231.71; 248/316.1

(58) Field of Search ..... 118/500, 502, 118/503; 269/17, 54.2, 71, 905; 248/231.71, 129, 316.1; 211/162, 163, 206

(56) References Cited

U.S. PATENT DOCUMENTS 1,462,803 A * 7/1923 Deserty
2,460,997 A * 2/1949 Myers
2,782,846 A * 2/1957 Bussard
3,071,253 A * 1/1963 Walsh et al.
3,643,935 A * 2/1972 Bill ..... 269/16
3,861,662 A * 1/1975 Morse
3,985,183 A * 10/1976 Fernbaugh
4,193,375 A * 3/1980 Sherland et al.
4,278,244 A * 7/1981 Carter ..... 269/17
5,164,011 A * 11/1992 Ray ..... 118/500
5,617,962 A * 4/1997 Chen ..... 211/206
5,894,945 A * 4/1999 Curran ..... 211/162
6,231,034 B1 * 5/2001 Walker et al. ..... 269/17

* cited by examiner

*Primary Examiner*—Laura Edwards

(57) ABSTRACT

A paint rack system for consolidating doors and shutters for spray painting and storing in an organized assembly. The system generally comprises an elongate base having opposite ends and a longitudinal axis. The longitudinal axis of the base is extended between the ends of the base, such that the ends of the base define a base length therebetween. A plurality of ground engaging members are coupled to the base. An elongate main beam has opposite ends and a longitudinal axis. The longitudinal axis of the main beam is extended between the ends of the main beam, and the ends of the main beam define a main beam length therebetween. The main beam is slidably mounted to the base, with the main beam being rotatably mounted to the base such that the main beam is rotatable about an axis of rotation being upwardly extended from the base. The axis of rotation is substantially perpendicular to the longitudinal axis of the base. A pair of spaced apart elongate arms each have a longitudinal axis, with the arms being upwardly extended from the main beam. Each of the arms has a plurality of spaced apart threaded clamping fasteners extending therethrough into the space between the arms, with the clamping fasteners being adapted for holding an object in the space between the arms.

8 Claims, 5 Drawing Sheets

MULTIPLE OBJECT PAINT RACK SYSTEM

BACKGROUND OF THE INVENTION

1. Field of the Invention

The present invention relates to devices for supporting objects during painting and more particularly pertains to a new multiple object paint rack system for consolidating objects such as doors and shutters for painting and storing the objects in an organized assembly, and for permitting the system and the objects mounted thereon to be easily wholly transportable between locations as secure and sturdy a unit.

2. Description of the Prior Art

The use of devices for supporting objects during painting is known in the prior art. More specifically, devices for supporting objects during painting heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,894,945; 5,617,962; 5,164,011; 4,278,244; 4,193,375; 3,985,183; 3,861,662; 3,643,935; 3,071,253; 2,782,846; 2,460,997; and 1,462,803.

While these devices fulfill their respective, particular objectives and requirements, the aforementioned patents do not disclose a new multiple object paint rack system described below.

The multiple object paint rack system according to the present invention substantially departs from the conventional concepts and designs of the prior art, and in so doing provides an apparatus primarily developed for the purpose of consolidating doors and shutters for spray painting and storing in an organized assembly.

SUMMARY OF THE INVENTION

In view of the foregoing disadvantages inherent in the known types of devices for supporting objects during painting now present in the prior art, the present invention provides a new multiple object paint rack system construction wherein the same can be utilized for consolidating doors and shutters for spray painting and storing in an organized assembly.

The general purpose of the present invention, which will be described subsequently in greater detail, is to provide a new multiple object paint rack system apparatus which has many of the advantages of the devices for supporting objects during painting mentioned heretofore and many novel features that result in a new multiple object paint rack system which is not anticipated, rendered obvious, suggested, or even implied by any of the prior art devices for supporting objects during painting, either alone or in any combination thereof.

To attain this, the present invention generally comprises a paint rack system for holding objects. The system generally comprises an elongate base having opposite ends and a longitudinal axis. The longitudinal axis of the base is extended between the ends of the base, such that the ends of the base define a base length therebetween. A plurality of ground engaging members are coupled to the base. An elongate main beam has opposite ends and a longitudinal axis. The longitudinal axis of the main beam is extended between the ends of the main beam, and the ends of the main beam define a main beam length therebetween. The main beam is slidably mounted to the base, with the main beam being rotatably mounted to the base such that the main beam is rotatable about an axis of rotation being upwardly extended from the base. The axis of rotation is substantially perpendicular to the longitudinal axis of the base. A pair of spaced apart elongate arms each have a longitudinal axis, with the arms being upwardly extended from the main beam. Each of the arms has a plurality of spaced apart threaded clamping fasteners extending therethrough into the space between the arms, with the clamping fasteners being adapted for holding an object in the space between the arms.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multiple object paint rack system apparatus and method which has many of the advantages of the devices for supporting objects during painting mentioned heretofore and many novel features that result in a new multiple object paint rack system which is not anticipated, rendered obvious, suggested, or even implied by any of the prior art devices for supporting objects during painting, either alone or in any combination thereof.

It is another object of the present invention to provide a new multiple object paint rack system which may be easily and efficiently manufactured and marketed.

It is a further object of the present invention to provide a new multiple object paint rack system which is of a durable and reliable construction.

An even further object of the present invention is to provide a new multiple object paint rack system which is susceptible of a low cost of manufacture with regard to both materials and labor, and which accordingly is then susceptible of low prices of sale to the consuming public, thereby making such multiple object paint rack system economically available to the buying public.

Still yet another object of the present invention is to provide a new multiple object paint rack system which provides in the apparatuses and methods of the prior art some of the advantages thereof, while simultaneously overcoming some of the disadvantages normally associated therewith.

Still another object of the present invention is to provide a new multiple object paint rack system for consolidating doors and shutters for spray painting and storing in an organized assembly.

Yet another object of the present invention is to provide a new multiple object paint rack system which includes The system generally comprises an elongate base having opposite ends and a longitudinal axis. The longitudinal axis of the base is extended between the ends of the base, such that the ends of the base define a base length therebetween. A plurality of ground engaging members are coupled to the base. An elongate main beam has opposite ends and a longitudinal axis. The longitudinal axis of the main beam is extended between the ends of the main beam, and the ends of the main beam define a main beam length therebetween. The main beam is slidably mounted to the base, with the main beam being rotatably mounted to the base such that the main beam is rotatable about an axis of rotation being upwardly extended from the base. The axis of rotation is substantially perpendicular to the longitudinal axis of the base. A pair of spaced apart elongate arms each have a longitudinal axis, with the arms being upwardly extended from the main beam. Each of the arms has a plurality of spaced apart threaded clamping fasteners extending therethrough into the space between the arms, with the clamping fasteners being adapted for holding an object in the space between the arms.

Still yet another object of the present invention is to provide a new multiple object paint rack system that can be disassembled quickly to transport to and from a job site, or for storage.

Even still another object of the present invention is to provide a new multiple object paint rack system that decreases the painting time while providing a superior finish.

Another object of the present invention is to support a plurality of doors or shutter pivotally and slidably along the elongated base member and the cross beam.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
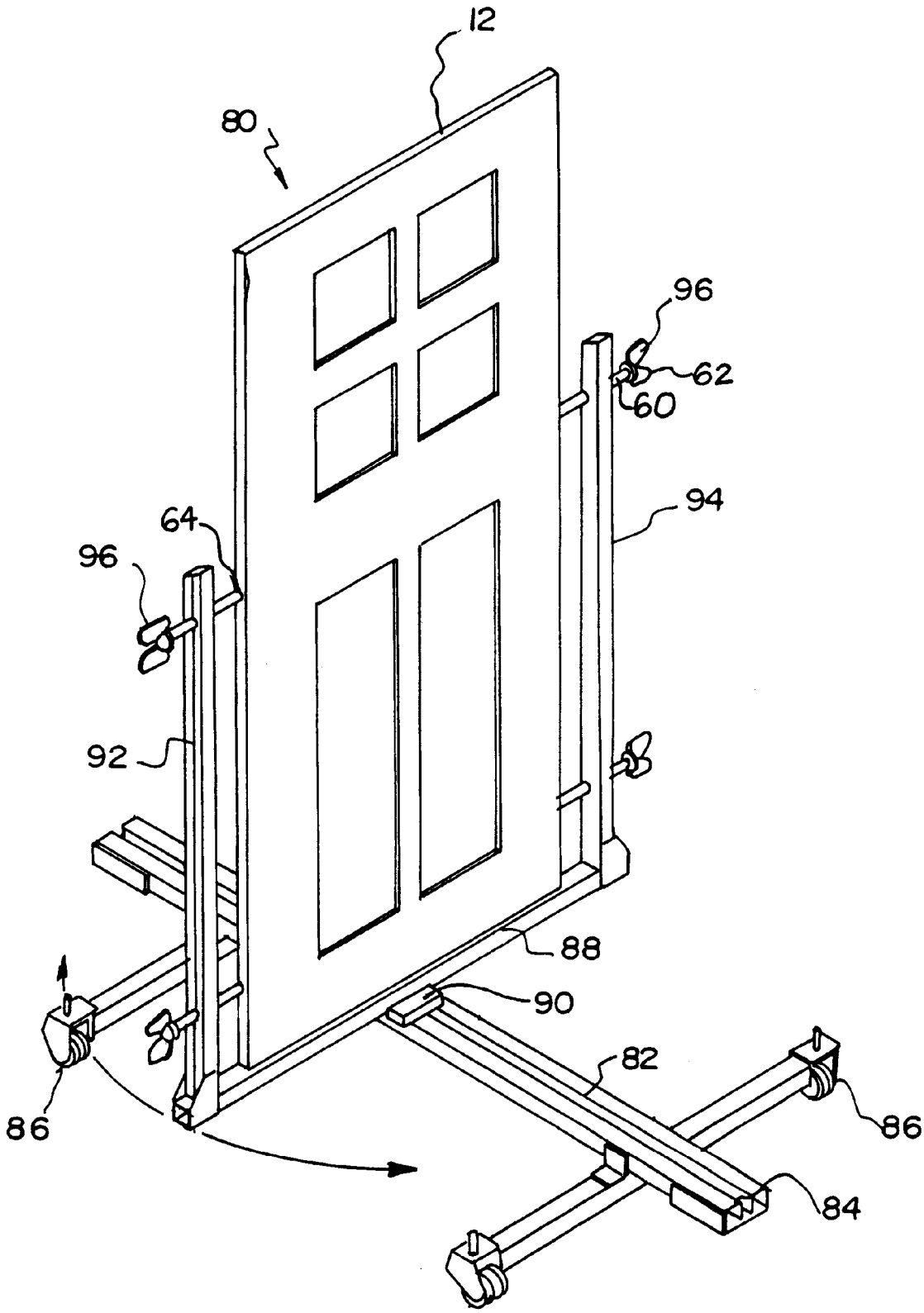
FIG. 1 is a schematic perspective view of the multiple object paint rack system according to the present invention, and particularly showing the present invention in use holding a door.

With reference now to the drawings, and in particular to FIGS. 1 through 6 thereof, a new multiple object paint rack system embodying the principles and concepts of the present invention and generally designated by the reference numeral 80 will be described.

Figure 2:
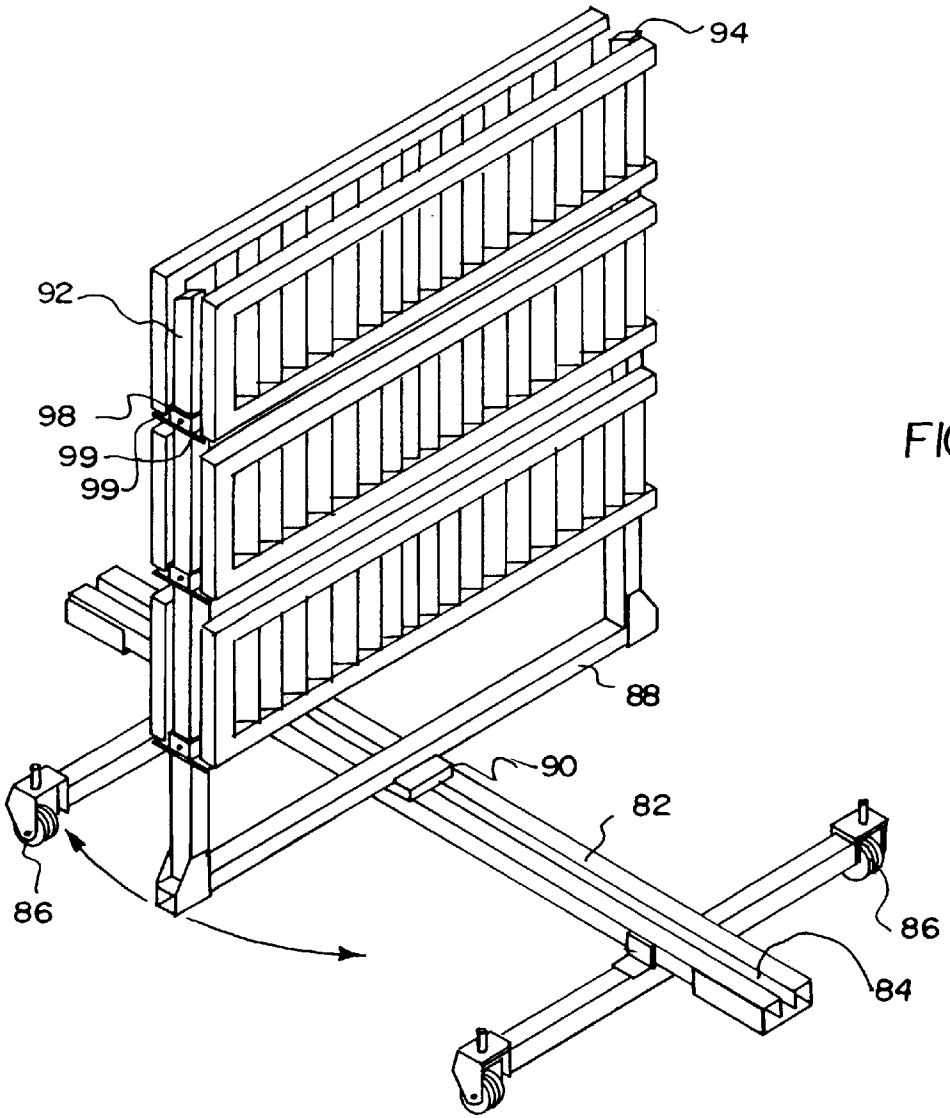
FIG. 2 is a schematic perspective view of the multiple object paint rack system of the present invention in use holding a plurality of shutters.

FIGS. 1 and 2 show two illustrative uses of the multiple object paint rack system of the invention. This system 10 comprises an elongate base 82 having opposite ends and a longitudinal axis which extends between the ends of the base 82. Preferably, the base 82 has a generally rectangular cross section taken substantially parallel to the longitudinal axis of the base 82. The base 82 preferably has an elongate channel 84 extending between its ends. A plurality of ground engaging members 86 are coupled to the base 82, and ideally the ground engaging members are wheels.

An elongate main beam 88 having opposite ends and a longitudinal axis extending between its ends. Like the base, the main beam 88 preferably has a generally rectangular cross section taken substantially parallel to the longitudinal axis of the main beam 88. The main beam 88 is slidably mounted to the base 82 such that the main beam 88 is slidable in the channel 84 of the base 82 between the ends of the base 82. The main beam is also rotatably mounted to the base 82 such that the main beam 88 is rotatable about an axis of rotation upwardly and perpendicularly extending from the base 82.

Preferably, a pivot member 90 slidably mounts and rotatably mounts the main beam 88 to the base 82. The pivot member 90 has an upper portion 100 and a lower portion 102 (see FIGS. 5 and 6). The lower portion is provided with a plurality of rollers for engaging the base. The upper portion 100 of the pivot member 90 is rotatably mounted to the lower portion 102 of the pivot member 90 to permit rotation of the upper portion of the pivot member 90 about the axis of rotation. Preferably, the upper portion of the pivot member has indexed rotation positions relative to the lower portion of the pivot member. The indexed rotation positions ideally include the angles of 0 degrees, 90 degrees, 270 degrees, and 360 degrees between the upper and lower portions of the pivot member. The lower portion of the pivot member 90 is slidably mounted to the to the base 82 such that the lower portion of the pivot member 90 is slidable in the channel 84 of the base 82 between the ends of the base 82. The upper portion of the pivot member 90 is coupled to the main beam 88 to complete the linkage.

A pair of spaced apart elongate arms 92, 94, are coupled to the main beam 88 such that they upwardly extend from the main beam 88. Preferably, the longitudinal axis of each of the arms 92, 94 is substantially perpendicular to the longitudinal axis of the main beam 88. Like the main beam, each of the arms 92, 94 has a generally rectangular cross section is taken substantially parallel to the longitudinal axis of the associated arm, one of the arms 92, 94 is located towards one of the ends of the main beam 88 and another of the arms 92, 94 is located towards another end of the main beam 88 so that they define a space for positioning an object therebetween.

As illustrated in FIG. 1, each of the arms 92, 94 has a plurality of spaced apart threaded clamping fasteners 96 are extended therethrough into the space between the arms 92, 94. The clamping fasteners 96 are designed for holding an object, such as a door 12, in the space between the arms 92, 94. The clamping fasteners 96 each preferably include a shaft 60 that extends through the arm 94 and that has a pair of opposite ends. One end includes a handle 62 for finger gripping to rotate the shaft, and may take the form of a handle having a pair of oppositely and outwardly extending "wings" that may be easily gripped and turned by the fingers of the user. The opposite end 64 of the shaft is adapted for abutting against an object to be painted, especially, for example, the narrow edge of a door or other relatively thin object. Significantly, the shaft may have a threaded exterior surface that engages threads on the interior of the hole through the arm in which the shaft is situated. This permits the turning of the shaft (by means of the handle 62) to extend and retract the abutting end 64 of the shaft into and out of the space between the spaced arms 92, 94. Thus, an object may be selectively pressed or "pinched" from opposite sides by the clamping fasteners on the spaced arms. The abutting end 64 may have a blunt shape or may be more pointed for concentrating the holding force on the object for a more secure holding of the object.

As illustrated in FIG. 2, each of the arms 92, 94 may optionally have a plurality of bracket members 98 adjustably mounted thereto. The bracket members 98 are mounted to their associated arm such that they are adjustably positionable along the length of their associated arm. Each of the bracket members 98 has a pair of oppositely extending tabs 99. The tabs 99 of each of the bracket members are extended substantially perpendicular to the longitudinal axis of their associated arm 92, 94. The bracket members 98 are designed for resting an object, such as shutters, extending between the arms 92, 94 thereon.

Figure 4:
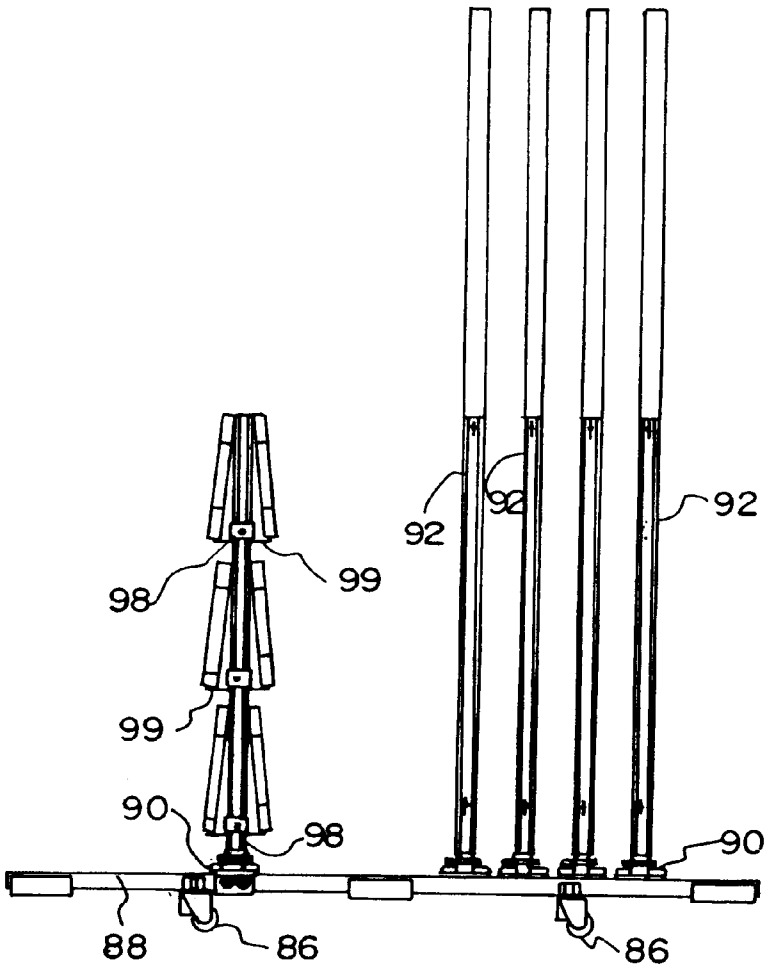
FIG. 4 is a schematic side view of the multiple object paint rack system of the present invention having a plurality of support structures mounted on the base.
Figure 3:
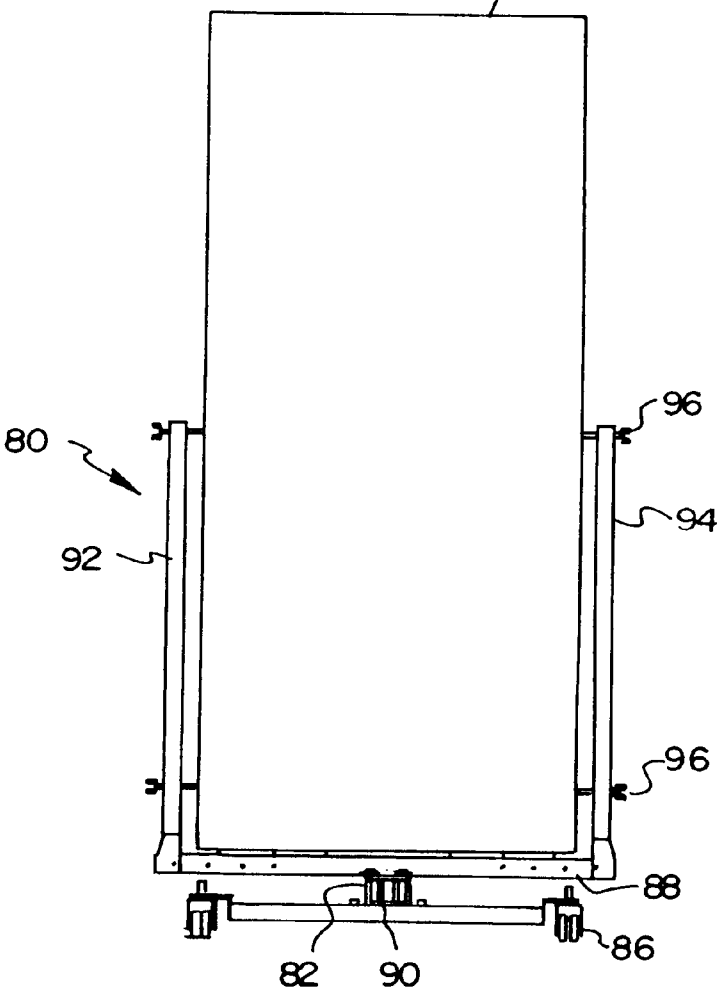
FIG. 3 is a schematic side view of the multiple object paint rack system of the present invention in use holding a door.
Figure 5:
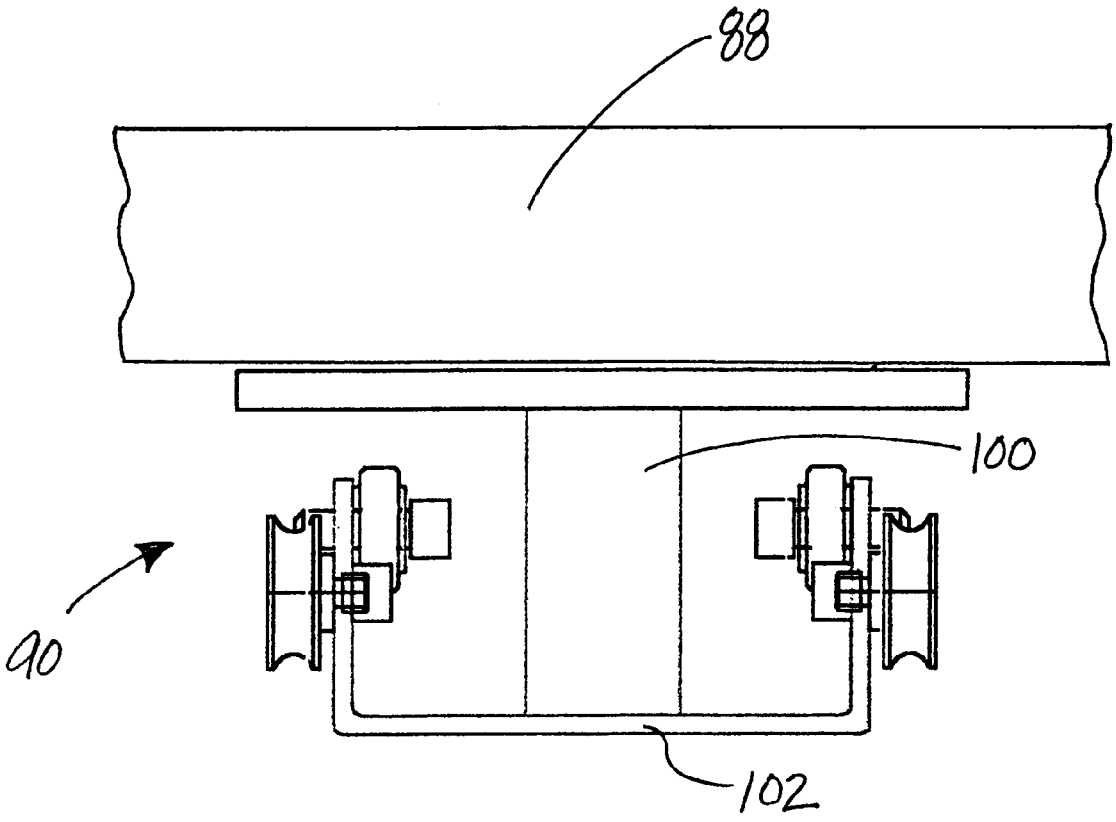
FIG. 5 is a schematic end view of the pivot member isolated from the rest of the present invention.
Figure 6:
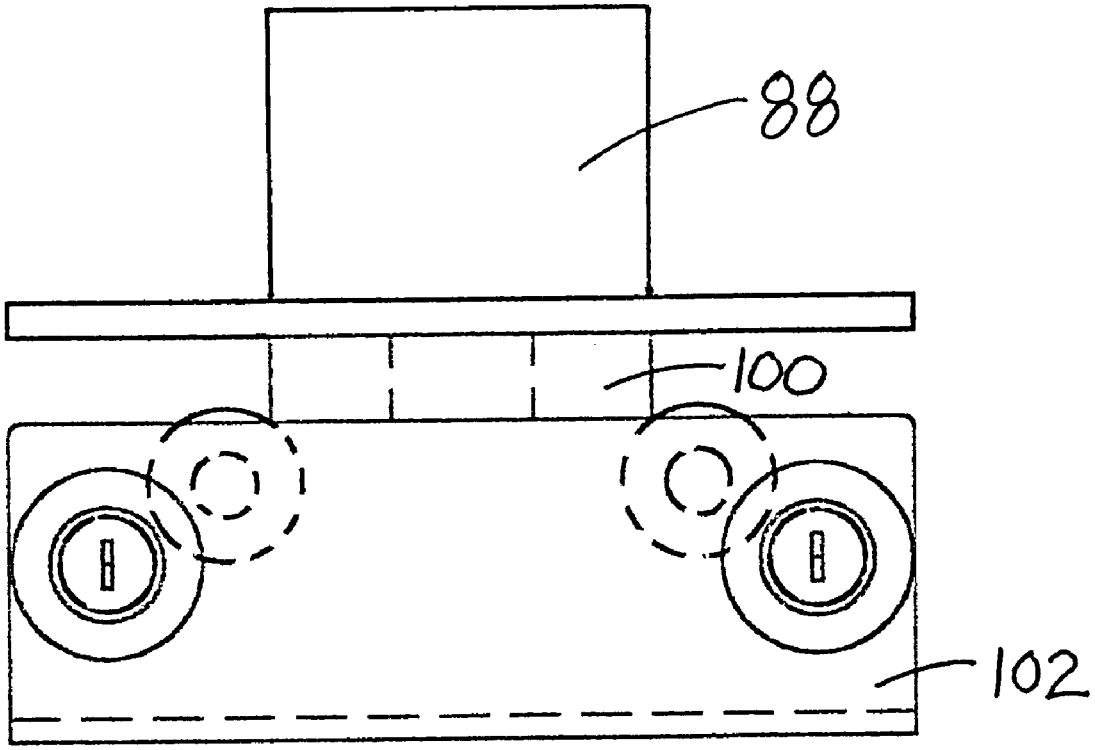
FIG. 6 is a schematic side view of the pivot member isolated from the rest of the present invention.

In use, as illustrated in FIG. 4, the channel 84 permits the mounting of a plurality of main beams (and associated arms) so that several objects may be supported by the invention 80. This allows a user a great deal of flexibility when using the invention to hold a variety of different objects thereon.

Significantly, the rack system may be easily transported from one location to another with a full complement of objects (such as doors, shutters, and the like) without having to remove the objects from the rack system. This greatly enhances the convenience and usability of the rack system, and, for example, eliminates any need to individually hand carry the objects to and from the painting location on a site.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paint rack system for holding objects, comprising:

an elongate base having opposite ends, and a longitudinal axis, said longitudinal axis of said base being extended between said ends of said base, wherein said ends of said base define a base length therebetween;

a plurality of ground engaging members being coupled to said base;

an elongate main beam having opposite ends, and a longitudinal axis, said longitudinal axis of said main beam being extended between said ends of said main beam, wherein said ends of said main beam define a main beam length therebetween;

said main beam being slidably mounted to said base, said main beam being rotatably mounted to said base such that said main beam is rotatable about an axis of rotation being upwardly extended from said base, said axis of rotation being substantially perpendicular to said longitudinal axis of said base;

a pair of spaced apart elongate arms, each of said arms having a longitudinal axis, said arms being upwardly extended from said main beam; and each of said arms having a plurality of spaced apart threaded clamping fasteners being extended therethrough into the space between said arms, said clamping fasteners being for holding an object in the space between said arms.

2. The system of claim 1 wherein said base has a generally rectangular cross section substantially parallel to said longitudinal axis of said base, wherein said main beam has a generally rectangular cross section substantially parallel to said longitudinal axis of said main beam, and wherein each of said arms has a generally rectangular cross section substantially parallel to said longitudinal axis of said associated arm.

3. The system of claim 1 wherein said ground engaging members comprise wheels.

4. The system of claim 1 wherein said base has an elongate channel being extended between said ends of said base, said main beam being slidably mounted to said base such that said main beam is slidable in said channel of said base between said ends of said base.

5. The system of claim 4 wherein a pivot member slidably mounts and rotatably mounts said main beam to said base, said pivot member having an upper portion and a lower portion, said upper portion of said pivot member being rotatably mounted to said lower portion of said pivot member to permit rotation of said upper portion of said pivot member about said axis of rotation, the upper portion of the pivot member having indexed rotation positions relative to the lower portion of said pivot member, said indexed rotation positions including angles of 0 degrees, 90 degrees, 270 degrees, and 360 degrees between said upper and lower portions of the pivot member, said lower portion of said pivot member being slidably mounted to said base such that said lower portion of said pivot member is slidable in said channel of said base between said ends of said base, said upper portion of said pivot member being coupled to said main beam.

6. The system of claim 1 wherein said longitudinal axis of each of said arms is substantially perpendicular to said longitudinal axis of said main beam.

7. The system of claim 1 wherein one of said arms is located towards one of said ends of said main beam, and another of said arms is located towards another end of said main beam.

8. The system of claim 1 wherein each of said arms has a plurality of bracket members being adjustably mounted thereto, said bracket members being mounted to their associated arm such that they are adjustably positionable along the length of their associated arm, each of said bracket members having a pair of oppositely extending tabs, said tabs of each of said bracket members being extended substantially perpendicular to the longitudinal axis of their associated arm, said bracket members being for resting another object extending between said arms thereon.

* * * * *